United States Patent [19]

Samson

[11] Patent Number: 4,878,439

[45] Date of Patent: Nov. 7, 1989

[54] EXTENDABLE TABLE

[76] Inventor: Ilan Samson, Rehov Eshkol 62, Tel-Aviv, Israel

[21] Appl. No.: 655,710

[22] Filed: Sep. 28, 1984

[30] Foreign Application Priority Data

Sep. 30, 1983 [IL] Israel ..... 69877

[51] Int. Cl.[4] ..... F16B 12/26

[52] U.S. Cl. ..... 108/83; 108/64

[58] Field of Search ..... 108/83, 64, 150, 88, 108/89, 90; 297/442

[56] References Cited

U.S. PATENT DOCUMENTS

| | | | |
|---|---|---|---|
| 1,017,062 | 2/1912 | Pfefferkorn et al. | 108/83 |
| 1,547,685 | 7/1925 | Rhodes | 108/83 X |
| 2,556,362 | 6/1951 | Crumpler | 108/64 X |
| 2,890,087 | 6/1959 | Stevens | 108/64 |
| 3,053,598 | 9/1962 | Cheslow | 108/64 |
| 3,826,206 | 7/1974 | Ruggles | 108/64 |
| 3,915,100 | 10/1975 | Sullivan | 108/64 |
| 4,158,335 | 6/1979 | Belcastro | 108/64 |
| 4,217,832 | 8/1980 | Pozzan | 108/64 X |
| 4,266,882 | 5/1981 | Wihelmi et al. | 108/83 X |

FOREIGN PATENT DOCUMENTS

| | | | |
|---|---|---|---|
| 1101580 | 4/1955 | France | 108/64 |

*Primary Examiner*—Peter A. Aschenbrenner

[57] ABSTRACT

A table, comprising a table top consisting of at least two table top elements with each table top element and the next adjacent table top element fitting together along an abutment line. Pedestal means is provided for directly supporting at least one but not all of the table top elements. The abutment line comprises a non-straight line and at least three pairs of cooperating interfitting male and female members are provided for connecting together each table top element and the next adjacent table top element. The pairs of cooperating male and female members are disposed at spaced apart locations in a non-collinear arrangement along the or each said abutment line. The pairs of cooperating members form the sole means of support for table top elements not provided with a pedestal and the weight of such elements is carried by shear stresses in the cooperating members and by bending stresses in the table top elements themselves.

10 Claims, 2 Drawing Sheets

EXTENDABLE TABLE

The present invention relates to extendable tables, and more particularly to such extendable tables which are extended by adding a number of leaves in between the two end parts of the table.

Common situations exist where the number of occupants of conference or dining tables can vary between a very small and a very large number. It is, therefore, useful to have a table the size of which can be varied from a very small to a very large length. Over such a big range this has to be done by the addition of a large number of sections. This could be done by adding leaves—as many as needed to form a table for any required length.

There are known many kinds and variations of such extendable tables, some of which are extended by leaves which are placed underneath the table's upper plate, thus limiting the number of leaves which can be stored and added, some of which are extended by means of leaves, each of which is supported by a separate support, thus requiring a support for each leaf, some of which are extended by means of leaves which are placed on some sort of bridge system which, for a large range of span, would be impractical, and in any case would have a pre-set limited length.

It is thus the main object of the present invention to provide a table in which an unlimited number of leaves could be added. Another object of this invention is to provide such a construction which requires one support under each third or so leaf only, and without the need for a bridge spanning between the supports. Yet another object of the present invention is to provide a table, the leaves and supports of which can be stored as flat elements and the assembly of which requires no tools.

In order to satisfy these objects there is provided, in accordance with the invention, a table comprising a table top consisting of at least two table top elements, wherein each table top element and the next adjacent table top element fit together along an abutment line, wherein pedestal means is provided for directly supporting at least one but not all of the table top elements, wherein the or each said abutment line comprises a non-straight line, wherein at least three pairs of cooperating interfitting male and female members are provided for connecting together each table top element and the next adjacent table top element, said pairs of cooperating male and female members being disposed at spaced apart locations in a non-collinear arrangement along the or each said abutment line, with one member of each pair being provided at one of said table top elements and the other member of the pair being provided at an adjacent table top element, said pairs of cooperating members forming the sole means of support for table top elements not provided with a pedestal, whereby the weight of a table top element not provided with a pedestal is carried by shear stresses in the cooperating members and by bending stresses in the table top element itself.

A table constructed in this way makes it possible to support extension leaves, added either in the middle of the table or to one or both ends thereof, in such a way that sagging is avoided without the need for substantial intermediate supports or support rails extending over the full length of the table. Specifically, the above arrangement makes it possible for the weight of the non supported table top elements or leaves to be carried by shear stresses in the pairs of cooperating interfitting male and female members and by bending stresses in the table top element itself. As substantial shear stresses can be born in practice by relatively slender members, and as most table top elements are themselves generally very resistant to bending, the arrangement of the invention makes it possible to support substantial weights stably without the need for massive supports and reinforcements. This is extremely advantageous, it allows the whole table to be totally knock-down as opposed to extension rail based tables and it reduces the amount of material required to construct a table, it results in a relatively light table for a given size, it makes it easy to store extension leaves because the cooperating pairs of male and female members do not make the leaves themselves objectionably bulky, and it also makes it possible to provide the table with an aesthetically pleasing design. Furthermore the table is made more comfortable from a user point of view because the room required to accommodate peoples' legs is not obscured by unnecessary pedestals.

There is no particular limitation on the precise shape of the abutment lines, they can follow a wavy line, roughly of S-shape, or zig-zag shape or any other regular or irregular non-straight line. In accordance with a further embodiment of the invention the abutment lines are S-shaped or V-shaped in plan view which makes it possible to provide a substantial distance or offset between a line joining the two outermost pairs of the three pairs of cooperating male and female members and the third intermediate pair. At the same time S-shaped and V-shaped lines provide a pleasing external appearence for the table. With V-shaped abutment lines it is possible to provide a center leaf which is approximately of diamond shape. Further extension leaves can be of chevron shape.

In one particularly prefered form of the table first and second table top elements located at first and second ends of the table are provided with pedestals, and at least one intermediate table top element is provided between said first and second table top elements. The intermediate table top element conveniently forms an extension leaf which can be added or removed at will to shorten or increase the length of the table.

The cooperating male and female members serve to prevent relative movement of adjacent table top elements in the direction normal to their plane, and also in the direction across the table and to this extend execute a function similar to the dowels normally provided for locating extension leaves in extendable tables.

The male and female members can be provided at the abutting edges of the table top elements so that the leaves need be no thicker than the leaf material itself. Alternatively, the cooperating male and female members can be provided beneath the abutting edges of the table top elements. This arrangement may be preferred where the table top elements are formed of a material such as chipboard and where problems might arise in feeding the bending stresses into the table top element itself at the pairs of male and female members.

The table top elements have undersides and are conveniently provided with a guide groove along the said undersides. This makes it possible to slide a first flat pedestal element into position beneath the table. A second pedestal element, which can also be a flat, areal, plate can be slotted together with the first mentioned pedestal plate at right angles and forms a very stable cross shaped pedestal of pleasing design. Because both the table top elements and the pedestal elements are all flat plates they can readily be stored and are economical to transport.

The invention will now be described by way of example only and with reference to the accompanying drawings in which.

Figure 1:
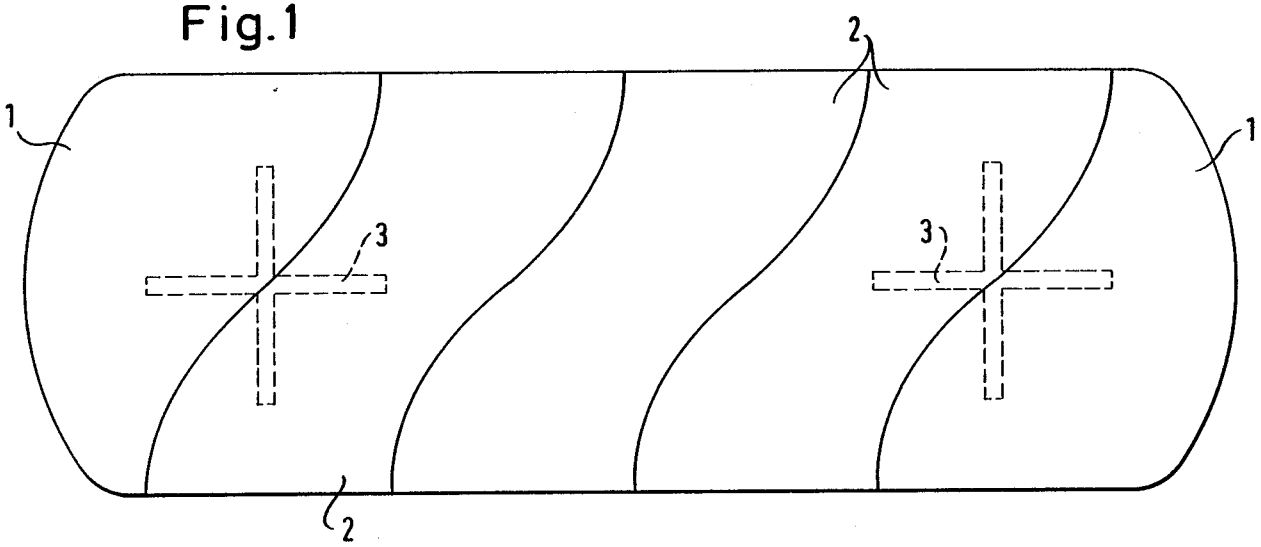
FIG. 1 is a plan view of a table top according to the invention.
Figure 2:
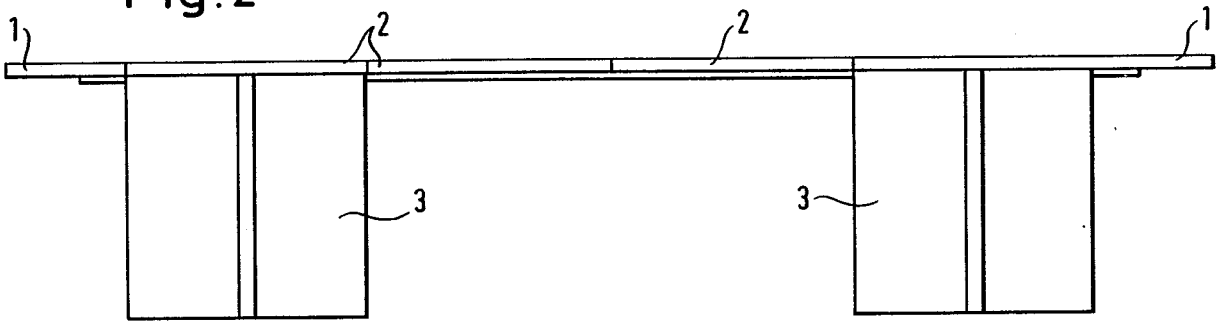
FIG. 2 is a side elevational view of the table of FIG. 1.
Figure 3:
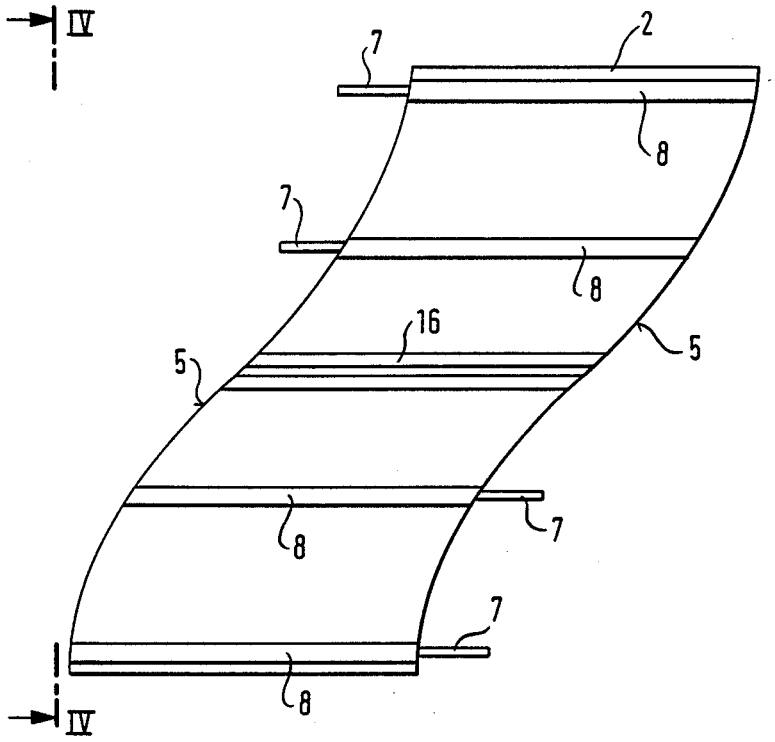
FIG. 3 is a plan view of a single extension leaf as seen from below.
Figure 4:
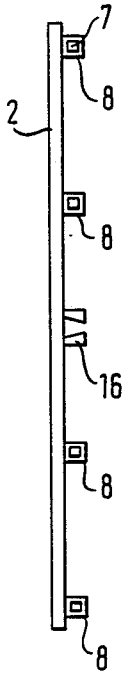
Figure 5A:
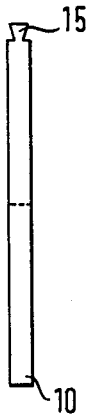
Figure 5B:
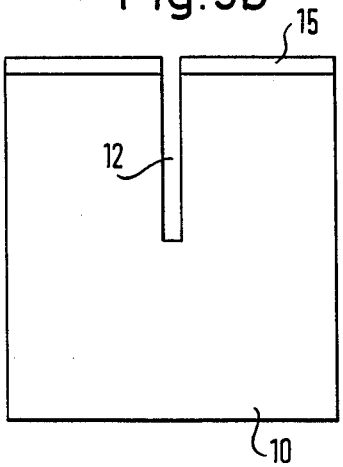
Figure 6:
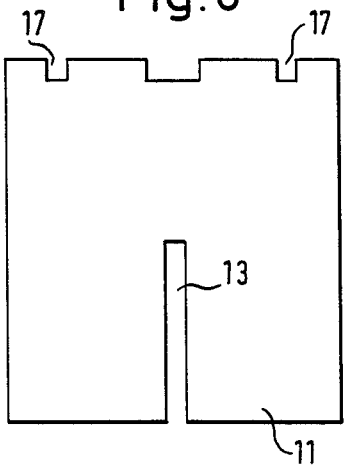

FIG. 4 is a side elevational view of the leaf of FIG. 3 as seen in the direction of the arrows IV in FIG. 3, FIG. 5*a*, 5*b* and 6 show two flat plates which form a pedestal; and FIGS. 7 and 8 show views similar to those of FIGS. 1 and 2 but with different shaped extension leaves.

Turning first to FIGS. 1 and 2 it can be seen that the table top comprises two end parts or elements 1 with extension leaves or elements 2 disposed intermediate the two endparts. The two endparts or elements are supported by means of pedestals 3. In the specific arrangement the pedestals each extend under two basic elements of the table top, this is however not essential.

As can be seen in FIGS. 3 and 4 an extension leaf 2 has two non-straight wave or unduluting shaped abutment edges 5 which are provided with four pairs of mating joining means. Each said pair of joining means comprises interfitting male and female members, such as a pin 7 and a tube or socket member 8 provided to receive the pin 7. The pins 7 should be a good fit in the tubes 8. In the illustrated embodiment the pins 7, which point in the extendable direction of the table, are located beneath the edge of the table top elements and the tubes 8 are correspondingly positioned below the associated table top element. When adjoining leaves are placed together the pins 7 of each leaf enter into the tubes 8 of the adjacent leaf. Alternatively, the pins and sockets can be provided at or in the abutting side edges of the associated table top element. In any event each leaf must be provided with at least three pairs of male and female members, which are not to be on one straight line.

The table is mounted by placing one leaf on a pedestal, and adding the next leaf by sliding the pins on one leaf into the tubes of the other leaf and so on. In this way as many extension leaves as required can be added.

The pedestals (FIGS. 5 and 6) consist of pairs of plates 10 and 11. A slot is cut halfway through each plate with the slots in the two plates extending in opposite directions to one another along the respective central vertical axes 12, 13 so that the plates may be slotted together to form a pedestal in the form of a cross when seen from above. A rail 15 along the upper edge of pedestal plate 10 (which is the plate with the slot along the upper half) is slidable in and along a guide groove 16 provided on the underside of the table top elements in the median line of the assembly. The guide groove 16 holds the rail 15 in the vertical direction in tongue in groove manner, and thus locks the other pedestal plate 11 in position. Cut-outs 17 in pedestal plate 11 permit movement of the plate past the tubes 8.

As mentioned before a pedestal is placed under every third or so leaf and not under each one as in the known extendable tables. This is achieved by using leaves with a non-straight edge line. If the shapes of the said edges were straight lines, the unsupported leaves would force bending stresses on the pins which could not be resisted in practice, by the pins. However, according to this invention the leaves have a non-straight edge line. When this is the case relative bending of the leaves over the general joining line would require by virtue of their geometry that some points on one leaf would undergo vertical displacement relative to the neighbouring points on the adjacent leaf. When the pins are located at such points (optionally, at the extremes, on both sides of the joining lines) shear forces would be exerted on them, and these are easy to overcome even by slender pins.

FIGS. 7 and 8 show an alternative embodiment with V-shaped abutment lines 18 provided between the individual elements of the table top. With these V-shaped abutment lines it is possible to provide a center leaf 19 which is approximately of diamond shape. The further extension leaves 2 can be of chevron shape.

Though the present invention is specifically directed to a table it will be appreciated that the underlying principle for connecting generally flat plate-like elements could also be used in other fields, for example in the construction industry for the construction of bridges and buildings. By way of example the bridge plates of a bridge, for example a temporary bridge, could be connected together in accordance with the present teaching with a substantial saving of material. This would be particularly advantageous for bridges for military purposes because it would only be necessary to transport a number of flat plates elements or structures to the bridge building side with substantial saving in the amount of space and number of transport vehicles required.

I claim:

1. A table comprising a table top consisting of at least two table top elements, wherein each table top element and a next adjacent table top element fit together along a respective abutment line, wherein pedestal means is provided for directly supporting at least one but not all of the table top elements, wherein each said respective abutment line comprises a non-straight line, wherein at least three pairs of cooperating interfitting male and female members are provided at each said respective abutment line and are disposed at spaced apart locations in a non-collinear arrangement along said respective abutment line, with one member of each pair being located at one of said table top elements and the other member of the pair being located at said adjacent table top element, for connecting together each table top element and the next adjacent table top element, said pairs of cooperating members forming the sole means of support for table top elements not provided with a pedestal, whereby the weight of a table top element not provided with a pedestal is carried by shear stresses in the cooperating members and by bending stresses in the table top element itself.

2. A table in accordance with claim 1 whereby said abutment lines are wave or undulated shaped in plan view.

3. A table in accordance with claim 1 wherein said abutment lines are V-shaped in plan view.

4. A table in accordance with claim 1 wherein first and second table top elements located at first and second ends of the table are provided with pedestals, and wherein at least one intermediate table top element is provided between said first and second table top elements.

5. A table in accordance with claim 4 wherein said at least one intermediate table top element forms an extension leaf.

6. A table in accordance with claim 1 wherein said pairs of cooperating male and female members prevent relative movement of adjacent table top elements in a direction normal to their plane.

7. A table in accordance with claim 1 wherein said pairs of male and female members are located at the abutting edges of said table top elements.

8. A table in accordance with claim 7 wherein said pairs of cooperating male and female members are located beneath the abutting edges of said table top elements.

9. A table in accordance with claim 1 wherein each said table top element has an underside, wherein a guide groove is located at the underside of each said table top element, wherein the guide grooves in said table top elements are aligned with each other, and wherein said pedestal means comprises a guide rail engageable in and slidable along said guide grooves.

10. A table which comprises two end parts and a plurality of extending leaves, said end parts and said leaves adjoining one another at respective connecting edges, wherein said connecting edges of said leaves follow a non-straight line of such formation that along said line there are at least three non-collinear points, wherein means act at at least said three non-collinear points to join two adjacent consecutive leaves preventing relative movement of the leaves in the direction perpendicular to their plane, and wherein some of the leaves have no means of stable support other than the said joining means which, on their own, would not be able to provide stable support for the leaves had the joints been collinear.

* * * * *